US005370562A

United States Patent [19]

Nanami

[11] Patent Number: 5,370,562

[45] Date of Patent: Dec. 6, 1994

[54] WATER INJECTION PROPULSION DEVICE

[75] Inventor: Masayoshi Nanami, Hamamatsu, Japan

[73] Assignee: Sanshin Kogyo Kabushiki Kaisha, Hamamatsu, Japan

[21] Appl. No.: 69,979

[22] Filed: May 28, 1993

[30] Foreign Application Priority Data

Jun. 19, 1992 [JP] Japan ..... 4-184727

[51] Int. Cl.[5] ..... B63H 11/113

[52] U.S. Cl. ..... 440/42

[58] Field of Search ..... 440/38, 40, 41, 42, 440/43, 44, 47; 60/221, 222; 239/451, 455, 461, 587.1, 587.5, 588

[56] References Cited

U.S. PATENT DOCUMENTS 3,143,857 8/1964 Eaton ..... 440/41
3,187,708 6/1965 Fox ..... 440/41
3,192,715 7/1965 Engel et al. ..... 440/42
3,623,447 11/1971 Jacobson ..... 440/42

FOREIGN PATENT DOCUMENTS 56-75296 6/1981 Japan .

*Primary Examiner*—David M. Mitchell
*Assistant Examiner*—Stephen P. Avila
*Attorney, Agent, or Firm*—Knobbe, Martens, Olson & Bear

[57] ABSTRACT

An improved steering control for a jet propelled watercraft wherein the steering control is provided by at least a pair of pivotally connected nozzle sections with the upstream nozzle section being pivoted first and the downstream nozzle section being pivoted second so as to permit a larger range of deviation in the discharge flow without obstructing the discharge nozzle of the jet propulsion unit. Both mechanical and hydraulic control systems are disclosed.

26 Claims, 5 Drawing Sheets

WATER INJECTION PROPULSION DEVICE

BACKGROUND OF THE INVENTION

This invention relates to a water injection propulsion device and more particularly to an improved discharge nozzle arrangement for a water jet propulsion unit.

The use of water jet propulsion units is well known and being quite widely accepted. Frequently it is the practice to mount a nozzle in registry with the discharge nozzle of the jet propulsion unit and which latter nozzle is pivotal for redirecting the water flow from the jet propulsion unit discharge nozzle for a variety of control purposes. Generally this is done at least to insure steering control for the watercraft and at times, also reverse thrust is accomplished in this manner.

Although these devices are quite adequate, particularly when traveling at relatively high speeds, their effectiveness at slow speeds can be reduced. The reason for this is if the control nozzle is pivoted through too large an angle, it will obstruct the flow through the main discharge nozzle and significantly reduce the performance. As a result, steering or control can be somewhat ineffective at slow vessel speeds.

It is, therefore, a principal object to this invention to provide an improved control nozzle arrangement for a jet propulsion unit which permits a greater range of control movement without adversely affecting the operation of the jet propulsion unit.

It is a further object to this invention to provide an improved steering nozzle for a jet propulsion unit.

SUMMARY OF THE INVENTION

This invention is adapted to be embodied in a jet propulsion unit for a watercraft having a hull propelled by the jet propulsion unit. The jet propulsion unit is provided with a discharge nozzle through which water is discharged under pressure for propulsion of the watercraft. A first control nozzle is supported for movement and has an inlet end that registers with the discharge nozzle for receiving water from it and redirecting it. A second control nozzle is supported for movement relative to the first control nozzle and receives water discharged from the discharge end of the first control nozzle for discharging it through its discharge end. In accordance with the invention, one of the control nozzles is moved through a first degree of angular movement and thereafter the other of the control nozzles is moved so as to further redirect the water flow for control operation.

DETAILED DESCRIPTION OF THE PREFERRED EMBODIMENTS OF THE INVENTION

Figure 1:
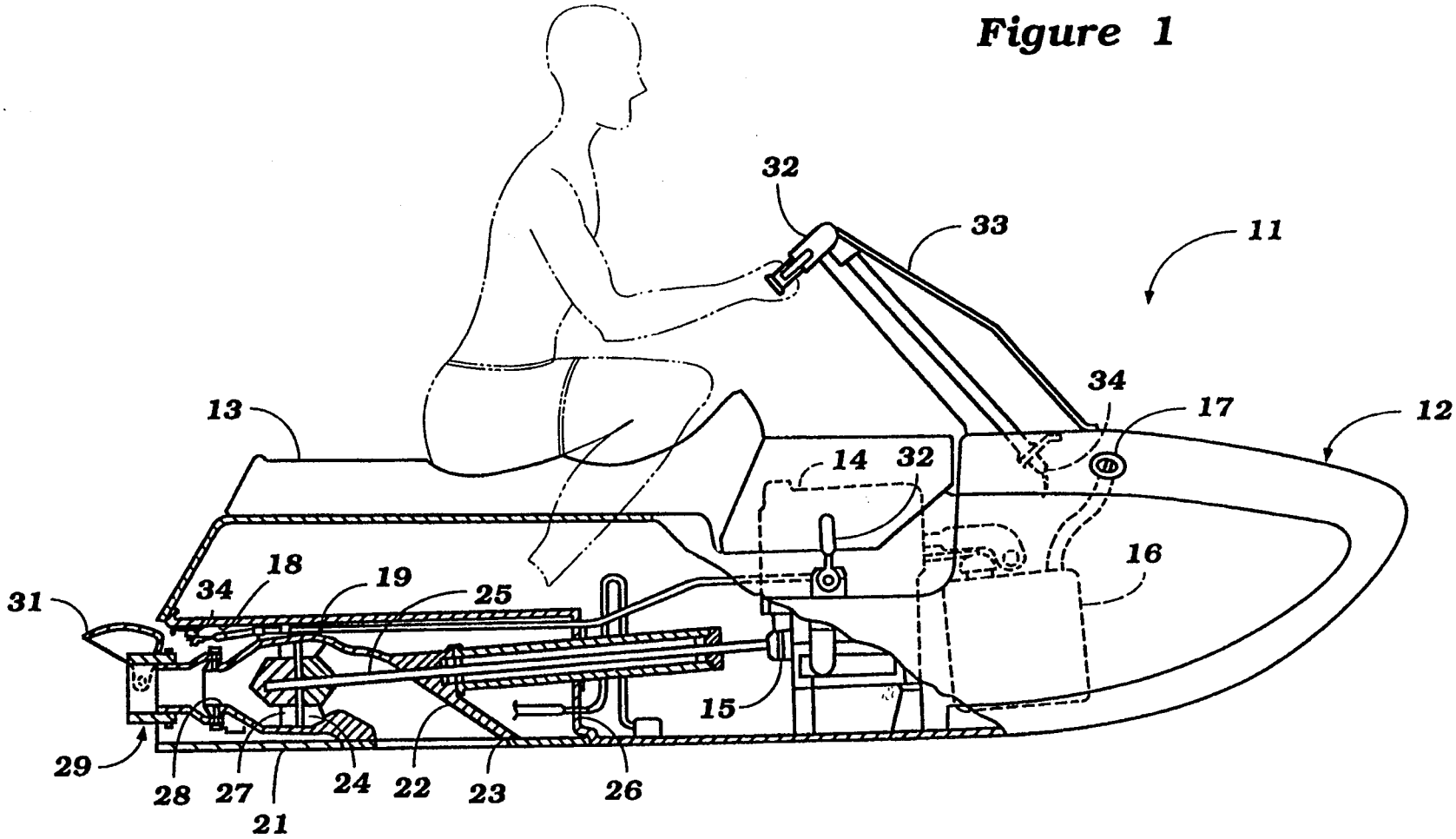
FIG. 1 is a side elevational view of a watercraft constructed in accordance with an embodiment of the invention, with a portion broken away and shown in cross section.

Referring first to FIG. 1, a small watercraft powered by a jet propulsion unit constructed in accordance with an embodiment of the invention is identified generally by the reference numeral 11. The small watercraft 11 in the depicted embodiment is of the type designed to be operated primarily by a single rider or a pair of riders seated in tandem, straddle fashion. It should be readily apparent to those skilled in the art, however, that the invention can be practiced with a wide variety of types of watercraft in addition to that described. Therefore, the description of the watercraft 11 is to be considered typical of an environment in which the invention may be practiced.

The watercraft 11 is comprised of a hull, indicated generally by the reference numeral 12 on which a rearwardly mounted seat 13 is provided. The seat 13 is adapted to accommodate, as aforenoted, one or more riders seated in tandem, straddle fashion. The sides of the hull 12 along the seat 13 are provided with depressed foot areas, as is well known in this art.

Forwardly of the seat 13 there is provided an engine compartment in which an internal combustion engine 14 of any known type is provided and which has an output shaft 15. In a typical embodiment, the engine 14 may be of the two or three cylinder in-line type and operates on a two cycle, crankcase compression principal. As will be readily apparent to those skilled in the art, however, the particular type of power plant employed is not critical to the invention.

Position forwardly in the engine compartment is a fuel tank 16 that supplies fuel to the engine 14 in any known manner. A filler neck 17 is provided on the upper forward portion of the hull 12 for filling of the tank 16.

Rearwardly of the engine compartment and beneath the seat 13, the hull 12 is formed with a tunnel 18 in which a jet propulsion unit, indicated generally by the reference numeral 19 is positioned. The jet propulsion unit 19 is supported in part on a closure plate 21 that is affixed to the underside of the hull 12 and which generally closes the tunnel 18.

The jet propulsion unit 19 is formed with a water inlet portion 22 that cooperates with a water inlet opening 23 formed in the closure plate 21 and through which water may be drawn by an impeller 24. The impeller 24 is affixed for rotation within an impeller shaft 25 which is coupled to the engine 14 for driving of the impeller 24 in a well known manner. The impeller shaft 25 extends forwardly through a bulkhead 26 which separates the tunnel 18 from the aforenoted engine compartment.

Water which has been pumped by the impeller 24 is driven rearwardly past straightening vanes 27 into a discharge nozzle portion 28 which faces rearwardly. A steering control nozzle arrangement, indicated generally by the reference numeral 29 is mounted in a manner to be described on the jet propulsion discharge nozzle portion 28 for steering control of the watercraft 11. In addition, a reverse thrust bucket 31 may be mounted on the downstream end of the control nozzle arrangement 29 and is operated by a shift lever 32 for reversing the direction of flow of water from the control nozzle 29 so as to provide rear thrust operation.

The invention deals primarily with the construction and operation of the control nozzle portion 29 and a first embodiment of this construction is shown in FIGS. 2 through 5 and will now be described in detail by reference to those figures.

As is well known in this art, it is the common practice to provide a steering nozzle in registry with the discharge nozzle 28 of a jet propulsion unit 19 for the purpose of steering the watercraft 11. Such an arrangement is provided in this embodiment and the steering nozzle is controlled by means of a handle bar assembly 32 that is mounted on a mast 33 forwardly of the seat 13 (FIG. 1). This handle bar assembly 32 controls a wire actuator 34 which is connected, in a manner to be described, to the steering nozzle.

Figure 2:
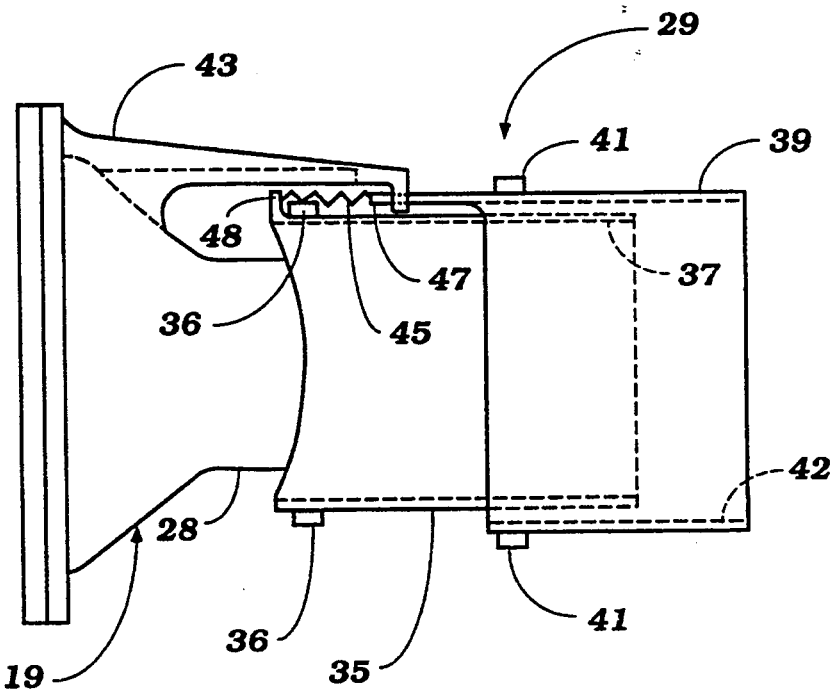
FIG. 2 is an enlarged side elevational view of the discharge nozzle and control nozzle arrangement for this embodiment.
Figure 3:
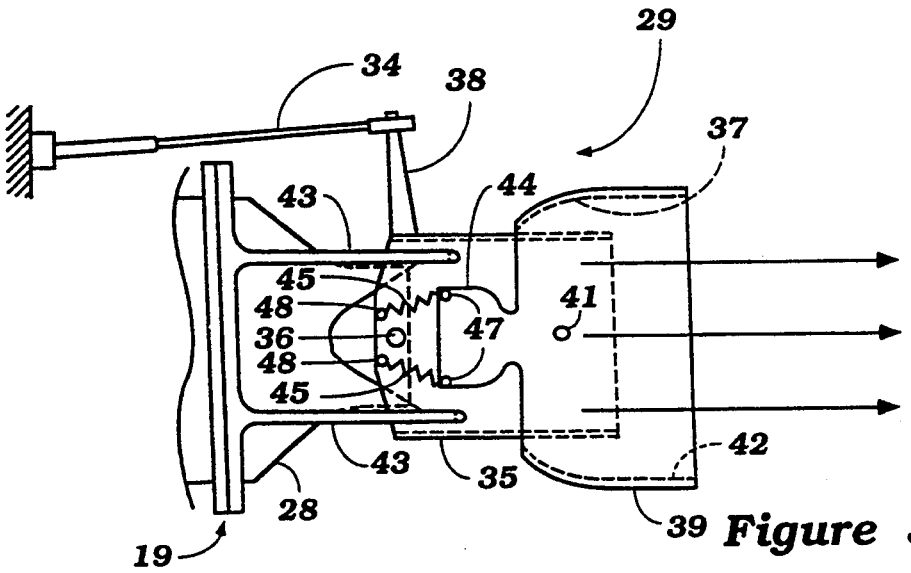
FIGS. 3 through 5 are top plan views showing the relationship of the discharge nozzle and the control nozzles during the full range of steering movement.
Figure 4:
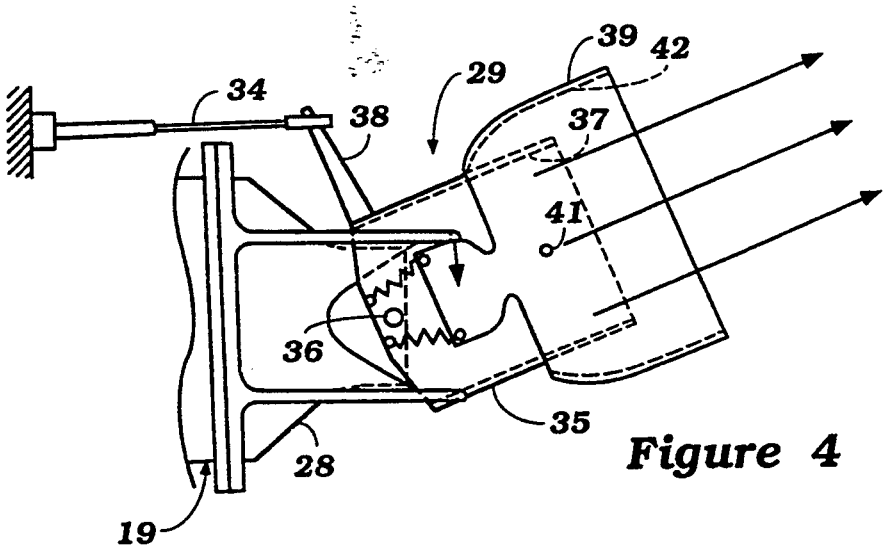

Referring now in details to FIGS. 2 through 4, the control nozzle assembly 29 functions in this embodiment as a steering nozzle. The control nozzle assembly 29 includes a first control nozzle portion 35 that is pivotally mounted at the discharge end of the jet propulsion unit discharge nozzle 28 on a pair of vertically disposed pivot pins 36. The first control nozzle 35 has an inlet end which communicates with the discharge end of the discharge nozzle 28 and a downstream discharge end 37.

A steering lever 39 is either affixed to or formed integrally with the first control nozzle portion 35 and is connected to the wire actuator 34 for its steering movement. As may be readily apparent, the maximum degree of pivotal movement of the first control nozzle 35 is effectively limited by the fact that it will obscure the discharge nozzle 28 of the jet propulsion unit 19 if it is steered through too large an angle. Although this presents no significant difficulties for steering at high speeds, it does limit the control for steering at lower speeds.

In order to accommodate a larger steering angle without obstructing the jet propulsion unit discharge nozzle 28, the control nozzle assembly 29 includes a second control nozzle 39 which is pivotally supported upon the discharge end of the first control nozzle 35 by a pair of vertically disposed pivot pins 41. The second control nozzle 39 has an inlet end that encompasses the outer periphery of the downstream or discharge end 37 of the first control nozzle 35 and its own downstream discharge end 42 that is positioned rearwardly of the first control nozzle discharge end 37.

In this embodiment, a cam mechanism is provided for pivoting the second control nozzle 39 relative to the first control nozzle 35. This cam mechanism includes a pair of extending cam arms 43 which may be conveniently formed on the jet propulsion unit discharge nozzle portion 28 and which extend rearwardly over the upper portion of the control nozzle assembly 29. In a similar manner, the second control nozzle 39 is provided with cam surfaces 44 that are disposed between the cams 43 when operating in the straight ahead position. A pair of tension springs 45 are loaded between pins 47 on the cam member 44 of the second control nozzle 39 and pins 48 formed on the first control nozzle 35. The tension springs 47 normally hold the second control nozzle 39 so that it will be aligned with the first control nozzle 35 as seen in FIGS. 3 and 4.

Figure 5:
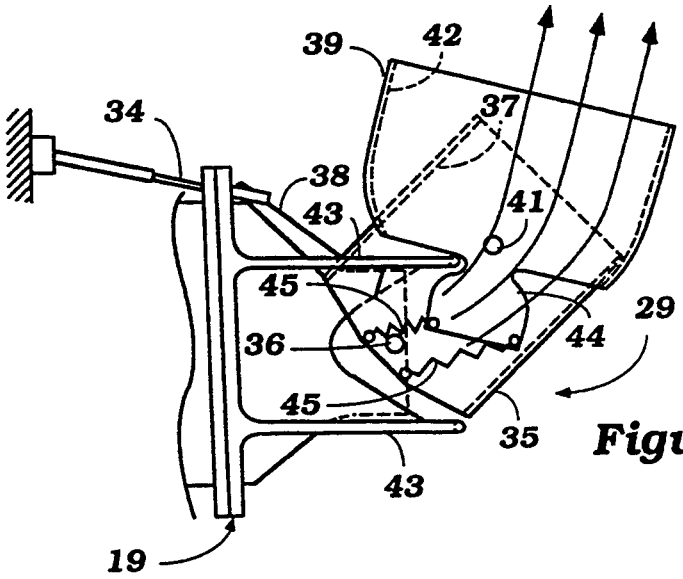

Once the first control nozzle 35 has been pivoted to the position shown in FIG. 4, the cams 43 and 44 will engage and further pivotal movement of the first control nozzle 35 will also effect pivotal movement of the second control nozzle 39. The geometry is such that the second control nozzle 39 will pivot through a greater angular extent than the first control nozzle 35 during this final movement. As a result and as shown in FIG. 5, once the control nozzles are fully pivoted to their extreme position there is a substantial redirection of the water flow while, at the same time, no obstruction of the jet propulsion unit discharge nozzle portion 38. Thus, much crisper steering can be accomplished, particularly at low speeds with no detrimental effect.

As should be readily apparent when the control nozzle 29 is steered back to the neutral position, the springs 45 will cause the second control nozzle portion 39 to return to the position shown in FIG. 4 when the first control nozzle 35 is returned to this position and both control nozzles will then move together in unison to the neutral position as shown in FIG. 3. The method by which steering in the opposite direction is accomplished is believed to be readily apparent.

Figure 6:
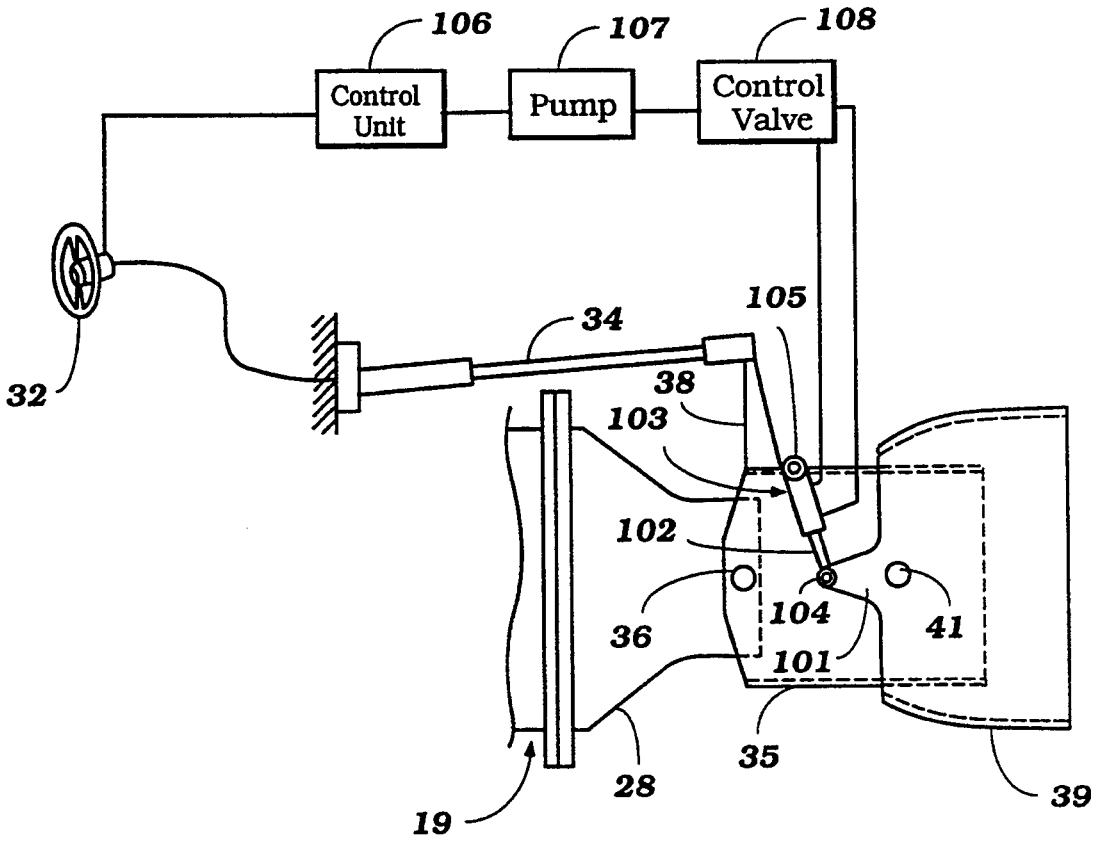
FIG. 6 is a top plan view, in part similar to FIG. 3, and shows another embodiment of the invention.
Figure 7:
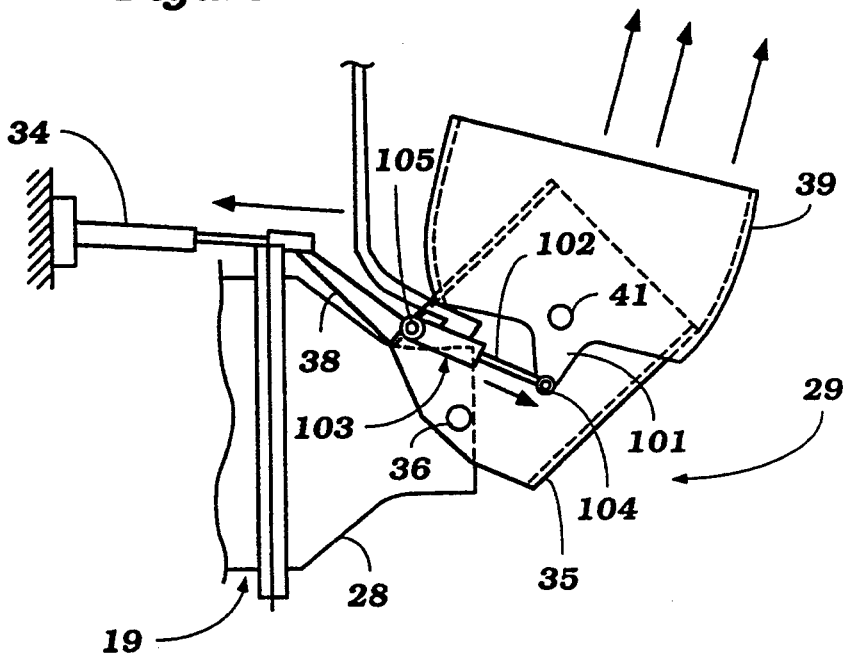
FIG. 7 is a partial top plan view, in part similar to FIG. 6, and shows the condition at the full range of control movement.
Figure 8:
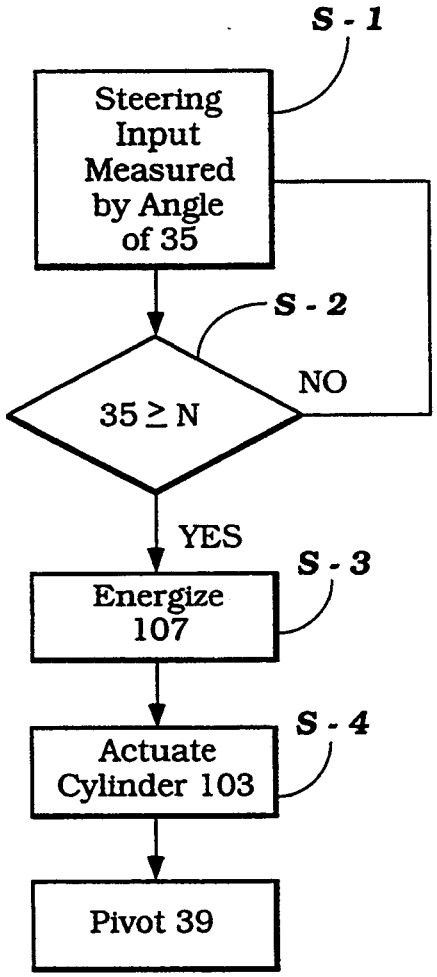
FIG. 8 is a block diagram showing the control routine of the embodiment of FIGS. 6 through 8.

In the embodiment of the invention as thus far described, the second control nozzle portion 39 of the control nozzle assembly 29 has been operated through a mechanical interconnection. Although such a construction has the advantage of simplicity, it does offer as much latitude in the way the two control nozzles are pivoted with respect to each other and FIGS. 6 through 8 show another embodiment of the invention. Except for the manner in which the second control nozzle portion 39 operated, the construction my be considered to be the same as that of the previously described embodiment and, for that reason, components which are the same or generally the same are identified by the same reference numerals and will not be described again, except insofar as is necessary to understand the construction and operation of this embodiment.

In this embodiment, like the previously described embodiment, the second control nozzle portion 39 is pivotally supported on the first control nozzle portion 35 by means of a pair of vertically disposed pivot pins 41. However, there is no other mechanical connection between the steering arm 38 of the first nozzle portion 35 and the steering of the second nozzle portion 39. Rather, in this embodiment, the second nozzle portion 39 has a forwardly extending top lug 101 that is pivotally connected to a piston rod 102 of a hydraulic cylinder assembly, indicated generally by the reference numeral 103 by means of a pivot pin 104. The cylinder assembly 103 is pivotally mounted on the first control nozzle portion 35 by means of a further pivot pin 105. As should be readily apparent, therefore, the operation of the hydraulic cylinder 103 can effect pivotal movement of the second control nozzle 39 relative to the first control nozzle 35.

The handle bar assembly 32, which is shown as a steering wheel in FIG. 6, in addition to being connected to the wire actuator 34 is connected a control unit 106 which, in turn, operates a hydraulic pump 107 which, in turn, is connected to a control valve 108 that selectively pressurizes the hydraulic motor 103 to affect pivotal movement of the second control nozzle 39.

FIG. 8 shows the control routine by which the hydraulic pump 107 and control valve 108 are operated. At the step S-1, the steering input of the handle bar 32 is measured so as to determine the pivotal movement of the first control nozzle portion 35. The program then moves to the step S-2 to determine if the angle of movement is greater than or equal to a predetermined angle N so as to require pivotal movement of the control nozzle portion 39. If it is not, the program repeats. If, however, there has been adequate movement of the steering handle bar 32 to pivot the first control nozzle portion 35 through an angle greater than or equal to N, than the program moves to the step S-3 so as to energize the pump 107 and the step S-4 so as to operate the control valve 108 to actuate the hydraulic cylinder 103 so as to effect pivotal movement of the second control nozzle portion 39. FIG. 7 shows the degree of movement when full steering control is effected. Return movement is the opposite of that described.

In the embodiments of the invention as thus far described, there have been provided two control nozzle portions. It is to be understood that even further control may be accomplish by providing an even greater number of control nozzle portions, each actuated in sequence from upstream to the downstream ends. The foregoing description is that of preferred embodiments of the invention and various changes and modification may be made without departing from the spirit and scope of the invention, as defined by the appended claims.

I claim:

1. A water jet propulsion unit comprising a discharge nozzle for discharging water under pressure to provide a propulsion force for an associated watercraft, a control nozzle assembly supported for movement relative to said discharge nozzle and including at least a first portion having an inlet end for receiving water from said discharge nozzle and a discharge end and movable through a first range and a second portion having an inlet in communication with the discharge opening of the first portion for receiving water therefrom in all portions of said sections and a discharge end for discharging water and movable through a second range, and means for effecting movement of said control nozzle portions in sequence in response to a control input so that one of said sections moves through a portion of its range of movement before the other of said sections moves through any of its range of movement relative to the one section.

2. A water jet propulsion unit as set forth in claim 1 wherein at least a portion of the movement of the other nozzle portion is accomplished simultaneous with movement of the first portion but at a greater rate.

3. A water jet propulsion unit as set forth in claim 1 wherein there is a mechanical interconnection for effecting the relative movements.

4. A water jet propulsion unit as set forth in claim 1 wherein the upstream control nozzle portion is moved prior to movement of the downstream control nozzle portion.

5. A water jet propulsion unit as set forth in claim 1 wherein at least a portion of the movement of the downstream nozzle portion is accomplished simultaneous with movement of the upstream portion but at a greater rate.

6. A water jet propulsion unit as set forth in claim 5 wherein there is a mechanical interconnection for effecting the relative movements.

7. A water jet propulsion unit comprising a discharge nozzle for discharging water under pressure to provide a propulsion force for an associated watercraft, a control nozzle assembly pivotally supported for movement relative to said discharge nozzle and including at least a first portion having an inlet end for receiving water from said discharge nozzle and a discharge end and a second portion having an inlet in communication with the discharge opening of the first portion for receiving water therefrom in all portions of said sections and a discharge end for discharging water, and means for effecting movement of said control nozzle portions in sequence in response to a control input wherein the control nozzle portions are supported for pivotal movement about vertically extending axes for effecting steering of the watercraft.

8. A water jet propulsion unit as set forth in claim 7 wherein one of the control nozzle portions is moved through a predetermined degree of movement before the other nozzle portion is moved.

9. A water jet propulsion unit as set forth in claim 8 wherein a portion of the movement of the other nozzle portion is accomplished simultaneous with movement of the first portion but at a greater rate.

10. A water jet propulsion unit as set forth in claim 9 wherein there is a mechanical interconnection for effecting the relative movements.

11. A water jet propulsion unit as set forth in claim 7 wherein the nozzles portions are moved in sequence to each other.

12. A water jet propulsion unit as set forth in claim 11 wherein the upstream control nozzle portion is moved prior to movement of the downstream control nozzle portion.

13. A water jet propulsion unit as set forth in claim 12 wherein the movement of the other nozzle portion is accomplished simultaneous with movement of the first portion but at a greater rate.

14. A water jet propulsion unit as set forth in claim 13 wherein there is a mechanical interconnection for effecting the relative movements.

15. A water jet propulsion unit as set forth in claim 1, wherein the first portion is supported for movement on the discharge nozzle and the second portion is supported for movement on the first portion.

16. A water jet propulsion unit as set forth in claim 15, wherein the first and second portions are supported for pivotal movement.

17. A water jet propulsion unit as set forth in claim 16, wherein the pivot axis for the second portion is disposed rearwardly from the pivot axis for the first portion.

18. A water jet propulsion unit as set forth in claim 17, wherein the first and second portions are rigid.

19. A water jet propulsion unit as set forth in claim 7, wherein the first portion is supported for pivotal movement on the discharge nozzle and the second portion is supported for pivotal movement on the first portion.

20. A water jet propulsion unit as set forth in claim 19, wherein the pivot axis for the second portion is disposed rearwardly from the pivot axis for the first portion.

21. A water jet propulsion unit as set forth in claim 20, wherein the first and second portions are rigid.

22. A water jet propulsion unit comprising a discharge nozzle for discharging water under pressure to provide a propulsion force for an associated watercraft, a control nozzle assembly supported for movement relative to said discharge nozzle and including at least a first portion having an inlet end for receiving water from said discharge nozzle and a discharge end, said first portion being movable through a first range of movement relative to said discharge nozzle, and a second portion having an inlet in communication with the discharge opening of the first portion and a discharge end for discharging water, said second portion being movable through a second range of movement relative to said first portion, and means for effecting movement of said control nozzle portions in response to a control input, the deflection of the water through said control nozzle assembly being greater than the movement of each of said sections when both of said sections are moved through their complete range.

23. A water jet propulsion unit as set forth in claim 22, wherein the first portion is supported for movement on the discharge nozzle and the second portion is supported for movement on the first portion.

24. A water jet propulsion unit as set forth in claim 23, wherein the first and second portions are supported for pivotal movement.

25. A water jet propulsion unit as set forth in claim 24, wherein the pivot axis for the second portion is disposed rearwardly from the pivot axis for the first portion.

26. A water jet propulsion unit as set forth in claim 25, wherein the first and second portions are rigid.

* * * * *